United States Patent [19]

Kramer et al.

[11] 4,072,233

[45] Feb. 7, 1978

[54] CONTAINER WITH FRANGIBLE PIERCING POINT

[75] Inventors: Karl Kramer, Wambach; Karlheinz Durst, Naurod, both of Germany

[73] Assignee: Hoechst Aktiengesellschaft, Frankfurt am Main, Germany

[21] Appl. No.: 714,250

[22] Filed: Aug. 13, 1976

[30] Foreign Application Priority Data

Aug. 16, 1975 Germany ..... 7526045[U]

[51] Int. Cl.[2] ..... B65D 5/54

[52] U.S. Cl. ..... 206/634; 229/62; 229/75; 206/245

[58] Field of Search ..... 222/541; 229/62, 66, 229/75; 206/245, 26, 634; 426/126

[56] References Cited

U.S. PATENT DOCUMENTS

| | | | |
|---|---|---|---|
| 3,078,201 | 2/1963 | Christie | 426/126 |
| 3,480,198 | 11/1969 | Repko | 229/66 |
| 3,524,566 | 8/1970 | Parks | 229/75 |
| 3,687,358 | 8/1972 | Wink et al. | 229/66 |

FOREIGN PATENT DOCUMENTS

| | | | |
|---|---|---|---|
| 1,281,140 | 10/1968 | Germany. | |
| 861,079 | 2/1961 | United Kingdom | 229/75 |
| 670,982 | 4/1952 | United Kingdom | 229/75 |

*Primary Examiner*—William Price
*Assistant Examiner*—Douglas B. Farrow
*Attorney, Agent, or Firm*—Richard L. Schwaab

[57] ABSTRACT

A container includes a plurality of walls that define an enclosed space. One of the container walls has a frangible piercing point thereon adapted to be penetrated by an extraction device such as a drinking straw, the piercing point being defined by a depression formed in the exterior surface of the container wall, but which does not penetrate completely through the wall. The depression is surrounded by an annular ring, which marks its location, and the container walls are preferably made of a plurality of layers of laminated material.

9 Claims, 4 Drawing Figures

CONTAINER WITH FRANGIBLE PIERCING POINT

BACKGROUND OF THE INVENTION

1. Field of the Invention

The present invention relates generally to containers for holding liquid or dry materials, and which are provided with an opening for removal of the material. More specifically, it relates to a bag, in particular a stand-up bag, provided with a frangible piercing point where an extraction device, such as a drinking straw, can be inserted into the container for effecting removal of the contents.

2. Description of the Prior Art

In addition to bottles and tin cans, certain types of flexible containers, especially stand-up bags which can be filled with liquid, pasty or dry goods, have recently gained acceptance. Such a stand-up bag is described, for example, in German Pat. No. 1,281,140. As opposed to tearing such bags open, cutting off their upper seal or one corner thereof, some of them are designed so that an extraction device, for example a drinking straw, can be pushed through the side wall thereof, the extraction device then being used to remove the contents of the bag.

However, since these bags usually consist of laminates, especially laminates including metal foils, e.g., aluminum, the insertion of the straw often presents difficulties, because the straws are relatively thin and tend to break or fold, and thus can no longer be used. On the other hand, if a drinking straw is pushed into the bag too hard, it may happen that both walls of the bag will be pierced, and that the contents will then leak out.

Bags of this type have been proposed that have an opening closed by a piece of an adhesive tape, or by a sealing strip on the outside wall of the bag. However, there are disadvantages associated with this manner of closing the opening, particularly if the bag is constructed of laminates. The contents of the bag in such an arrangement are in permanent contact with the different layers of the laminate, which may be foil, at the opening where the bag is to be pierced. Thus, the adhesive binding the layers of the laminate can be attacked by the contents, or, in the case of composite foils having metal layers, these are affected. This may lead to delamination and thus destruction of the bag. Furthermore, the contents may be contaminated by the attack upon the adhesive binding the laminates, or on the metal foil.

There is thus need for a new bag construction, one that avoids the difficulties associated with known bags of the present type.

SUMMARY OF THE INVENTION

It is the principal object of the present invention to provide a container having a normally closed opening which can be easily pierced by an extraction device, especially a drinking straw, in order to remove the contents.

Another object is to provide a container having laminate walls with a normally closed opening which can be easily pierced by an extration device, especially with a drinking straw, and which avoid attacks on the adhesive binding the laminate layers, or on the metal layer of the laminate.

A further object is to provide a bag having such a frangible piercing point thereon.

In a bag constructed according to the present invention, at least one side of the wall of the bag is provided with a frangible piercing point. The piercing point is defined by a stamped or otherwise formed depression which extends from the outside toward the inside of the wall of the bag, but which does not completely pierce the wall. Thus, the wall of the bag is weakened at the piercing point, and a straw or the like can be easily pushed through the piercing point for access to the contents of the bag.

Because the frangible piercing point of the invention does not completely penetrate the wall of the bag and leaves the innermost laminate layer intact, all difficulties with the bag contents attacking and delaminating the bag wall are reliably avoided with the invention. This is true even in the instance of agressive goods, such as fruit juices and fruit drinks. At the same time, the invention makes it possible to easily and safely pierce an opening in the bag with a straw or the like.

While the stamped or otherwise formed depression of the invention may be advantageously applied to all laminates prone to chemical attack, it has proved to be particularly advantageous for use with bags composed of three or four layer foils, e.g., polyester-aluminum-polyethylene laminates, or "Cellophane" ®-aluminum-polyethylene laminates.

Other objects, features and many of the attendant advantages of the present invention will become readily apparent from the following Description of the Preferred Embodiments, when taken in conjunction with the accompanying drawings.

DESCRIPTION OF THE PREFERRED EMBODIMENTS

In the invention the piercing point on the bag is made by cutting, stamping, or otherwise forming a depression part way through the wall of the bag. The depression may have any desired shape, e.g., circular, oval, jagged, angular, V-shaped, simi-circular, Y-shaped and the like. In practice, however, it has been found that a circular depression functions best.

The depth of the depression is not too material, provided it meets the requirements that the wall of the bag is not completely pierced, and that the resultant piercing point can be penetrated easily by the extraction device, say a drinking straw. In practice, however, it has been found advantageous if the depth of the depression is from about ⅔ to 4/5 of the thickness of the bag wall.

The width of the depression is also not too material, and may be up to several centimeters. However, widths of up to 1/10 mm have been found to be very suitable in practice. The depressions are made with conventional tools, for example adjustable stamping tables, heated dies and the like.

In order to facilitate location of the depression by the user for removal of the goods, the area of the depression is preferably marked on the outside of the wall of the bag, for example, with a somewhat protruding circular ridge, or by the application of a plastic or paper label.

The use of the stamped or otherwise formed depression comprising the frangible piercing point of the invention is not restricted to bags of a particular design and construction. It has proved to be particularly advantageous, however, for use on stand-up bags, especially those described in German Pat. No. 1,281,140, the disclosure of which is hereby incorporated by reference.

Figure 4:
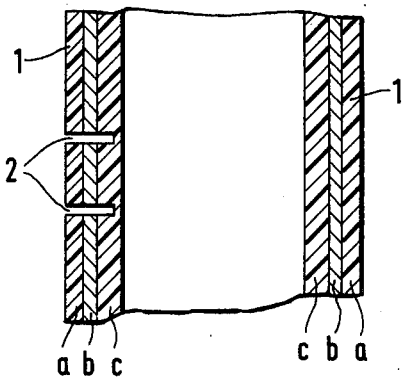
FIG. 4 is a fragmentary cross-sectional view taken through a laminated bag in the region of the frangible piercing point, showing that the circular depression defining the annular piercing point stops short of penetrating through the inner layer of the laminate.

Referring now to FIG. 4 of the drawing, a bag is shown having walls 1 of laminated construction, each wall including layers *a, b* and *c,* which can respectively consist of polyester, aluminum and polyethylene. The frangible piercing point of the invention is made in FIG. 4 by stamping or otherwise forming an annular depression 2 in the outside of one of the bag walls 1. As is clearly shown in FIG. 4, the annular depression 2 stops short of penetrating the innermost laminate layer *c,* whereby the contents of the bag are contained and cannot reach the layers *a* and *b,* or the adhesive used to laminate the several layers.

Figure 1:
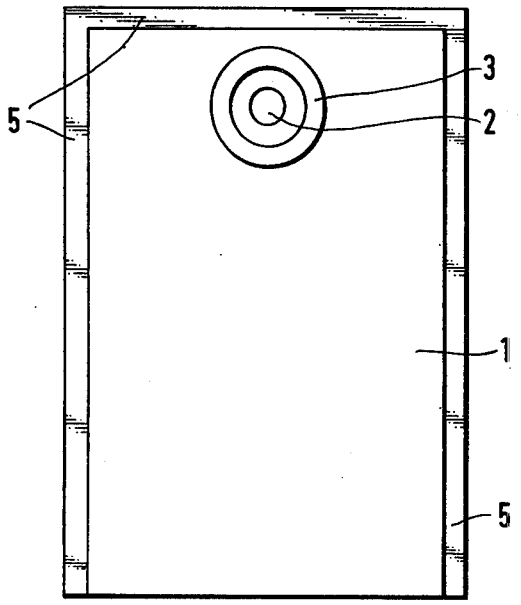
FIG. 1 is a front elevational view of a bag which is sealed along three edges thereof, and which is provided with a first embodiment of the frangible piercing point of the invention, wherein a circular ridge marks the location of the piercing point.

In FIG. 1 a bag 1' is shown which is closed on three sides by seals 5. Near the top thereof the bag 1' has a circular or annular depression 2' formed therein, in the manner of the depression 2 of FIG. 4. An annular, protruding ring 3 is formed on the wall of the bag 1' to surround the depression 2', and functions to mark the location of the frangible piercing point provided on the bag 1' by the depression 2'.

Figure 2:
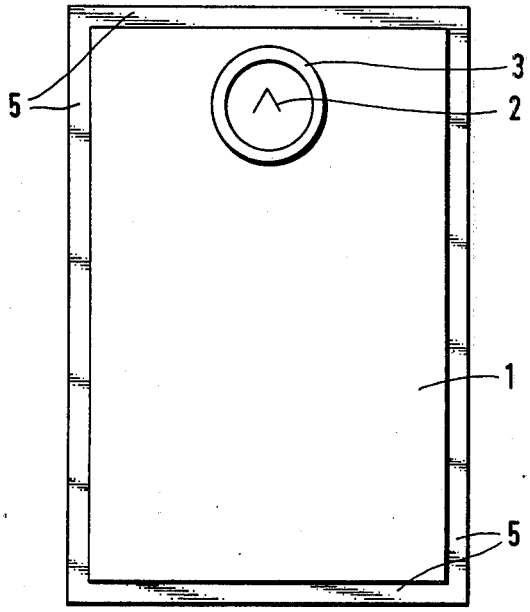
FIG. 2 is a front elevational view of a bag which is sealed along all four edges thereof, and showing a second embodiment of the invention wherein the frangible piercing point is formed in the shape of a triangle, the piercing point being marked by an annular label attached to the bag wall.

The bag 1'' of FIG. 2 is formed with seals 5' on all four sides thereof, and is provided with a depression 2'' formed in the shape of a triangle. In this instance the piercing point is marked by an annular label 3' attached to the bag wall, which can be made of paper, plastic or another desired material.

Figure 3:
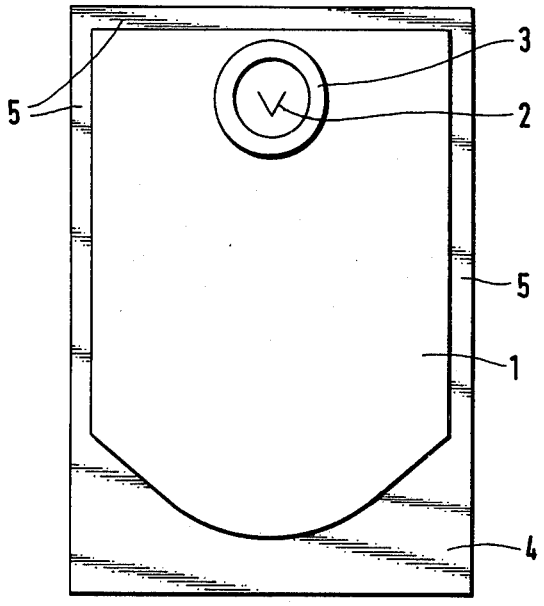
FIG. 3 shows another embodiment of a bag, wherein the bag is provided with a bottom capable of supporting it in an upright position, the bag incorporating a frangible piercing point like that of FIG. 2.

Referring now to FIG. 3, the bag 1''' therein is provided with seals 5'' on three sides thereof, and has a bottom 4 capable of supporting the bag in an upright position. In FIG. 3 the depression 2''' forming the frangible piercing point is in the form of a V, and is surrounded with an annular label 3' like that of FIG. 2.

Obviously, many modifications and variations of the invention are possible.

What is claimed is:

1. A container comprising:

a plurality of container walls made of laminated layers of material and defining a closed interior space, one of said walls having a frangible piercing point thereon arranged to be penetrated by an extraction device or the like, said piercing point being defined by a circumscribing depression formed in the exterior of said wall, and which extends from the outside of said wall toward the inside thereof, but which does not completely pierce the innermost laminate layer of said wall, substantially the entire portion of said wall circumscribed by said depression remaining in place at substantially full thickness until said piercing point is penetrated by said extraction device or the like.

2. A container as recited in claim 1, wherein said walls are comprised of three layers of laminated material, the outermost layer being made of polyester plastic, the middle layer being aluminum foil, and the innermost layer being made of polyethylene plastic.

3. A container as recited in claim 1, wherein said container is a bag.

4. A container as recited in claim 1, wherein said frangible piercing point is surrounded by an annular ring for marking its location.

5. A container as recited in claim 4, wherein said annular marking ring is a raised embossment formed on said container wall.

6. A container as recited in claim 4, wherein said annular marking ring is a separate element attached to said container wall.

7. A container as recited in claim 1, wherein said depression has a circular configuration.

8. A container as recited in claim 1, wherein said depression has an angular configuration.

9. A container as recited in claim 3, wherein said bag is provided with a bottom portion arranged to support the bag in an upright position.

* * * * *